US012753665B2

(12) United States Patent
Bhudolia et al.

(10) Patent No.: US 12,753,665 B2
(45) Date of Patent: Oct. 6, 2026

(54) AROMATIC COPOLYESTER THERMOSET DOWNHOLE TOOLS

(71) Applicant: Halliburton Energy Services, Inc., Houston, TX (US)

(72) Inventors: Somen Kumar Bhudolia, Singapore (SG); Michael Linley Fripp, Singapore (SG); Sandeep Thatathil, Singapore (SG); Arpana Singh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/828,253

(22) Filed: Sep. 9, 2024

(65) Prior Publication Data

US 2025/0109644 A1 Apr. 3, 2025

Related U.S. Application Data

(60) Provisional application No. 63/586,278, filed on Sep. 28, 2023.

(51) Int. Cl.
*E21B 23/00* (2006.01)

(52) U.S. Cl.
CPC ..... *E21B 23/00* (2013.01); *E21B 2200/08* (2020.05)

(58) Field of Classification Search
CPC ..... E21B 23/00; E21B 2200/08
See application file for complete search history.

(56) References Cited

U.S. PATENT DOCUMENTS

| | | | | |
|---|---|---|---|---|
| 7,673,673 | B2 * | 3/2010 | Surjaatmadja | E21B 43/114 166/177.5 |
| 9,534,138 | B2 | 1/2017 | Economy et al. | |
| 11,130,293 | B2 | 9/2021 | Meyer et al. | |
| 11,254,032 | B2 | 2/2022 | Lan et al. | |
| 11,346,178 | B2 | 5/2022 | Takahashi et al. | |
| 2013/0025859 | A1 * | 1/2013 | Liang | E21B 41/00 507/224 |
| 2013/0240201 | A1 * | 9/2013 | Frazier | E21B 34/063 166/135 |
| 2015/0284586 | A1 * | 10/2015 | Economy | C09D 167/00 524/502 |
| 2016/0177655 | A1 * | 6/2016 | Fripp | E21B 33/129 166/376 |
| 2019/0040220 | A1 * | 2/2019 | Meyer | C08J 9/0076 |
| 2020/0023598 | A1 | 1/2020 | Lan et al. | |
| 2020/0247937 | A1 * | 8/2020 | Taynton | C08L 61/20 |

OTHER PUBLICATIONS

Available at https://www.stratviewresearch.com/articles/Dissolvable-Frac-Plugs--Simplifying-and-Accelerating-OG-Production, accessed Sep. 5, 2024.
Study and Field Trials on Dissolvable Frac Plugs for Slightly Deformed Casing Horizontal Well vol. Fracturing Peng Zhang, Chunsheng Pu*, Jingyang Pu, and Zhihui Wang ACS Omega 2022, 7, 12, 10292-10303.
Kureha, Kuredux Polyglycolic Acid (PGA)—Technical Guidebook, Apr. 2011.
Bashandeh, K., Lan, P. & Polycarpou, A.A. Tribology of self-lubricating high performance ATSP, PI, and PEEK-based polymercomposites up to 300° C. Friction 11, 141-153 (2023).
ATSP Innovations, Estherm™—Advanced Aromatic Polyesters, 2024. Available at https://www.atspinnovations.com/products/estherm, Accessed Sep. 5, 2024.
Readily recyclable carbon fiber reinforced composites based on degradable thermosets: a review Green Chem. 2019, 21, 5781-5796.
Shau, Abhra & Jana, Chhayarani & De, P & Ray, P . . . (2012). Aspects of polymers and polymeric composites in chemical process industries.
Maghsoudi, Khosrow; Vazirinasab, Elham; Momen, Gelareh; Jafari, Reza (2020). Advances in the Fabrication of Superhydrophobic Polymeric Surfaces by Polymer Molding Processes. Industrial & Engineering Chemistry Research, ( ), acs.iecr.0c00508.
Plastics Technology, Sherman, Unique Class of Polymers behave like Crosslinked Thermosets and Process like Thermoplastics, 2020.
ATSP Innovations, Estherm-advanced aromatic polyesters, 2018.
ATSP Innovations, Inc. Jacob Meyer, PhD, Assembly and Reuse of Aromatic Thermosetting Copolyester, 2021.
Compositesworld, Malnati, New Polymer expands composites options in demanding environments, Feb. 2022.

* cited by examiner

*Primary Examiner* — Silvana C Runyan
(74) *Attorney, Agent, or Firm* — Scott Richardson; C. Tumey Law Group PLLC

(57) ABSTRACT

A variety of methods and apparatus are disclosed, including, in one embodiment, a downhole tool for use in a borehole, wherein the downhole tool comprises a composite of an aromatic copolyester thermoset (ACT) and a reinforcement material, wherein the ACT has a glass transition temperature of at least 150° C., wherein the ACT is configured to degrade in a water-based fluid having high pH, and wherein the method can include providing the water-based fluid having the pH, such as a pH of at least 11, at least 12, at least 13, or at least 14 in the wellbore, thereby degrading or dissolving the ACT of the downhole tool in the wellbore.

22 Claims, 8 Drawing Sheets

AROMATIC COPOLYESTER THERMOSET DOWNHOLE TOOLS

BACKGROUND

Boreholes may be drilled into subterranean formations to recover valuable hydrocarbons, among other functions. Operations may be performed before, during, and after the borehole has been drilled to produce and continue the flow of the hydrocarbon fluids to the surface. Downhole tools in the borehole (wellbore) may facilitate the production of the hydrocarbon fluids from the subterranean formation. Downhole tools in the borehole (wellbore) may be utilized in reworking the borehole. Removal of these downhole tools from the wellbore is conventionally by complex retrieval operations, or by milling or drilling the tool out of the wellbore mechanically. Thus, downhole tools can be either retrievable or disposable. Disposable downhole tools have traditionally been formed of drillable metal materials (e.g., cast iron, brass and aluminum) and non-metallic materials (e.g., plastic composites). The milling and drilling can be a time consuming and expensive operation.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
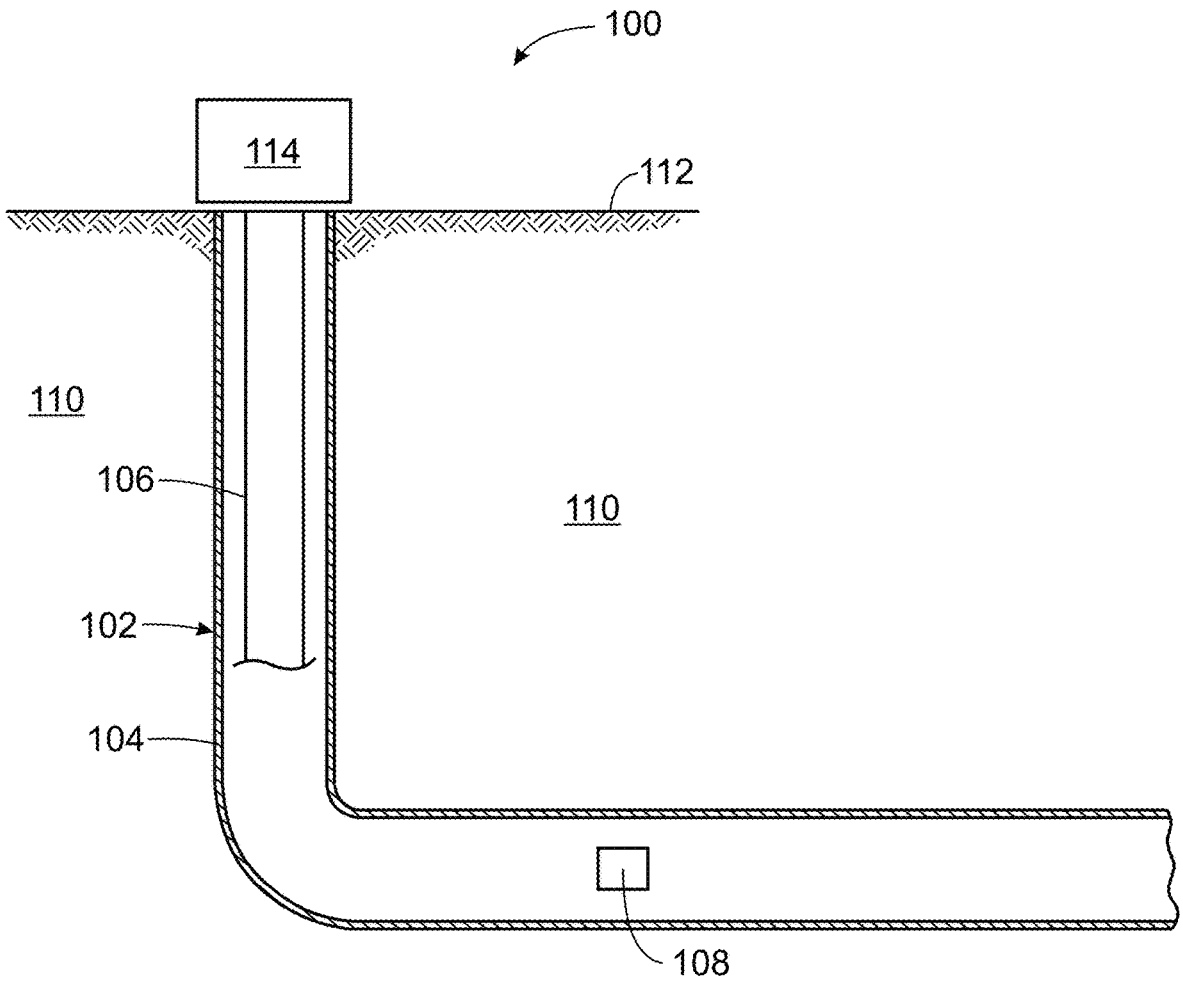
FIG. 1 is a diagram of a well site that includes a wellbore (borehole) and in which a downhole tool is in the wellbore.

Disclosed herein are degradable (dissolvable) downhole tools constructed from a polymer [e.g., aromatic copolyester thermoset (ACT)] having a glass transition temperature ($T_g$) of at least 150° C. The downhole tool degrades in a wellbore in response to presence of a water-based fluid (in the wellbore) having pH of at least 11, at least 12, at least 13, or at least 14. Degradation can be substantially losing mechanical strength. In implementations, a material can be considered degraded when its tensile strength is less than 20% of its original tensile strength. In some cases, this degradation can occur through dissolution or through swelling. At a pH of at least 14, the ACT may dissolve, for example, at less than one week or even less than 4 hours. At a pH of at least 11, at least 12, or at least 13 the ACT may generally swell shortly after exposure and may eventually dissolve after adequate time. This high pH dissolution fluid (e.g., pH in the range of 11 to 14.3) can be introduced into the wellbore by pumping from the surface, and/or generated downhole in the wellbore by reacting the existing downhole fluid with a solid precursor (e.g., sodium hydroxide, potassium hydroxide, calcium hydroxide, etc.) to form the high pH fluid.

ACT resin has a relatively high $T_g$ and thermal stability and is applicable as a dissolvable material for downhole applications due to vulnerability of ACT to strong bases. ACT resin can be used as a material to manufacture dissolvable downhole tools and can be an alternative to dissolvable metals or to other dissolvable polymers. In implementations herein, downhole tools are made from pristine or fiber-reinforced ACT and in which the downhole tools dissolve in presence of strong bases.

There are generally no conventional downhole components that are a polymeric composite in which the material can resist high temperature (greater than 200° C.) and that can be readily chemically dissolved or degraded. Embodiments herein address this deficiency in providing downhole tools that are a polymeric composite that resist high temperature and can be dissolved (degraded) downhole. For instance, an ACT vitrimer (polymer) and its composites are utilized in downhole tools as a dissolvable material.

Aspects of the present disclosure is ACT as a material for downhole tools in which pristine ACT and reinforced ACT interact with strong bases to dissolve (degrade). Embodiments include a high-temperature dissolvable polymer (e.g., ACT) for downhole equipment (tools) in hydraulic fracturing and other downhole applications. The downhole tool, or one or more of the downhole tool components, can be a composite of dissolvable ACT and filler material (e.g., particles, fibers, etc.). The filler material reinforces the ACT. The filler material can be labeled as reinforcement material. The composite may have, for example, 1 weight percent (wt %) to 80 wt %, or about 10 wt % to about 40 wt %, of the filler material (reinforcement material). The term "about" as used herein with respect to numerical values means an +10% to −10% so that here, for instance, about 40 wt % means between 36 wt % and 44 wt %.

In utilizing ACT resin as a dissolvable material, downhole tools can be manufactured from ACT by injection molding, extrusion, compression molding, casting, hand layup, liquid injection techniques, tape layup, fiber placement, filament winding, pultrusion, resin transfer molding, and other allied polymer and polymer composite manufacturing techniques. For a composite of ACT and reinforcement material, the reinforcement material can include short fibers, long fibers, continuous fibers, particles, and other fillers as reinforcement in the dissolvable (degradable) ACT. The ACT vitrimer resin is utilized as the matrix or binder in the composite. Fibers can be carbon, glass, aramid, boron, basalt, metal, polyethylene, polypropylene, poly(p-phenylene-2,6-benzobisoxazole) (PBO) (Zylon®), and others. The fillers may include, for instance, micro-fillers (particles or micro-tubes) and nanofillers (particles or nanotubes), such as carbon black, graphite, boron, graphene, glass, silica, pigment, or other nanotubes.

Degradable materials of conventional dissolvable downhole tools are not ACT and include, for example, aliphatic polyesters based on hydroxycarboxylic acid such as polylactic acid (PLA) and polyglycolic acid (PGA), lactone-based aliphatic polyesters such as poly-caprolactone (PCL), and the like. There are generally no conventional downhole tools of non-metallic material technology in which the material can both resist high temperature (operating at temperatures of at least 150° C.) and be dissolved or degraded in contact with strong bases. Here, the phrase "operating at" may mean that the tensile strength is at least 40% of the material's tensile strength at room temperature.

Aspects of the present disclosure include downhole tools or downhole tool components that are an ACT reinforced with filler material. While the ACT is a thermoset, the ACT exhibits thermoplastic behavior. Embodiments of the ACT may be a vitrimer and thus the ACT can be labeled as ACT vitrimer. ACT can be utilized, for example, as an oligomer or a cured powder, or both.

Disclosed herein are downhole equipment (e.g., tools) or downhole equipment components formed from a composite of an ACT and reinforcement material (e.g., fibers), and that or degradable or dissolvable. In some cases, the reinforcement material is dissolvable or partially dissolvable. It may be desirable to have a dissolvable reinforcement material when the reinforcement is composed of long fibers. In some embodiments, the reinforcement is not dissolvable. A non-dissolvable reinforcement is generally acceptable when the reinforcement is short fibers or particles. In implementations, the rate of degradation of the reinforcement and the rate of degradation of the ACT may be significantly different. In implementations, a degradable component or a dissolvable component can be defined herein as a component that will lose greater than 80% of its tensile strength after exposure to the degradation fluid within a time between 1 hour and 1 month. The ACT (ACT vitrimer) can be labeled as a resin or as a polymer. In examples, the ACT is formed by crosslinking oligomers that have lower molecular weight than the ACT. Both the oligomers (before crosslinking) and the ACT (as a thermoset after crosslinking) can have the following structure in a repeat unit of the main chain of the chemical structure:

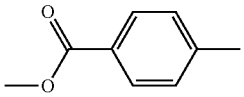

which includes the aromatic ring (benzene ring). Also, the depicted structure includes a carbon single bonded to an oxygen, double bonded to another oxygen, and single bonded to a carbon of the aromatic ring.

Thus, examples of the ACT includes an aromatic polyester backbone. The oligomers and the ACT may be carboxylic acid-capped (capped with a carboxylic acid functional group as end group) or acetoxy-capped (capped with an acetoxy functional group as an end group). The crosslinked network of the ACT morphology may be composed of an aromatic polyester backbone interconnected via covalent single and double oxygen bonds. At least a portion of the ACT matrix is generally amorphous but this is not a requirement. In implementations, the percent crystallinity may be, for example, in the range of 0% (no crystallinity) to 6%.

An embodiment may include downhole tool having a structure that is a composite of ACT (e.g., vitrimer resin) and a reinforcement material (e.g., particles or fibers, or both). In implementations, the reinforcement material as fibers can include carbon, glass, aramid (can be aromatic polyamide), boron, basalt, polyethylene, polypropylene, PBO, or natural fibers, or any combination thereof. If natural fibers are utilized, the natural fibers can include flax or jute, or both, and other natural fibers.

Again, a downhole tool can be constructed from the degradable/dissolvable ACT polymer and its composites. These tools are employed, for example, to separate fluids and for other reasons. The downhole tools or downhole tool components that can be constructed from the dissolvable ACT material can include, for example, pressure housings, connectors, couplings, pressure barriers, frac plugs, frac balls, frac sleeves, ball seats, inflow control device (ICD) plugs, perforation charge carriers, perforating guns assemblies, and the various parts that constitute these components.

FIG. 1 is a well site 100 that includes a wellbore 102 (borehole). In the illustrated implementation, the wellbore 102 includes casing 104 (wellbore casing) and production tubing 106 installed in the wellbore 102. The production tubing 106 (if present) may be a tubing string utilized in the production of hydrocarbons. The wellbore 102 is formed through the Earth surface 112 into the subterranean formation 110 in the Earth crust.

A downhole tool 108 is deployed (installed) in the wellbore 102. The downhole tool 108 is or includes a composite of ACT and filler (reinforcement) material, as discussed. The filler material can be long, short, and/or woven fibers. The filler material can be particulate fillers. The composite of ACT and filler (reinforcement) material is degradable or dissolvable in the presence of an aqueous fluid having high pH (e.g., a pH of at least 11). Embodiments of the ACT generally do not degrade unless the pH is high (and with respect to temperature are stable, for example, up to 350° C.) and do not thermally degrade at temperatures below 500° C. The degradation rate of the ACT in neutral pH (pH of 7) or in low pH (e.g., in hydrochloric acid solution at pH in range of 2-6) is very slow to non-existent. A material is considered stable in neutral and low pH fluid when its tensile strength remains within 50% of its original tensile strength after 1 month of exposure. Embodiments of the ACT have such stability (and thus are stable) in a water-based fluid having pH in the range of 2-7 at temperatures less than 500° C. (e.g., in the range of 0° C. to 500° C.) or less than 350° C. (e.g., in the range of 0° C. to 350° C.).

The downhole tool 108 is depicted as the simplified representation of a square for clarity. The downhole tool 108 may be, for example, a plug (e.g., frac plug, bridge plug, ICD plug, etc.), a packer, a gauge mandrel, a pressure housing, instrumentation (e.g., having a pressure housing), pressure barriers, frac ball, frac sleeves, perforation charge carrier, perforating guns assembly, and so on. The downhole tool 108 may include tubing, piping, a valve, etc. Some downhole tools 108 may be disposed on or near production tubing 106 in certain implementations.

For removal or displacement of the downhole tool 108 from the wellbore 102, the downhole tool 108 may be subjected to a high pH fluid, as mentioned, to dissolve the downhole tool 108 or dissolve components of the downhole tool 108. After degradation (e.g. dissolution) of the downhole tool 108 or component(s) of the downhole tool 108, the degraded or dissolved material may, for example, be produced with wellbore fluid from the wellbore 102 to the surface 112. Any residual material of the downhole tool 108 not dissolved may flow with wellbore fluid to the surface 112 and be separated (if desired) from the wellbore fluid at the surface 112.

To degrade (e.g., swell and/or dissolve) the downhole tool 108, the high pH dissolution fluid (e.g., pH of at least 10, at least 11, at least 12, at least 13, at least 13.5, or at least 14) can be introduced into the wellbore 102 by pumping from the surface 112 or by forming the high pH dissolution fluid in the wellbore 102. The high pH dissolution fluid can be formed downhole in the wellbore 102 by reacting the existing downhole fluid with a solid precursor (e.g., solid sodium hydroxide, solid potassium hydroxide, solid calcium hydroxide, etc.) to generate a high pH fluid. For example, the solid precursor can be dissolved in the existing wellbore fluid (e.g., aqueous) to form a high pH fluid. Sodium hydroxide can dissolve in polar fluids, for example, that include water, ethanol, and/or methanol. The solid precursor can be anhydrous compound or a monohydrate. The solid precursor can form hydrates. The term hydrate is used to describe dissolution in any polar fluid.

In some cases, the solid precursor (e.g., solid sodium hydroxide, potassium hydroxide etc.) is compounded into the ACT polymer (resin) of the downhole tool 108. Thus, in those cases, there would be inclusions of the solid precursor within the ACT polymer. If so, the solid precursor can optionally be coated with a barrier coating, such as PLA plastic, in order to ease incorporation of the solid precursor within the resin. In implementations, reinforcement material is or includes the solid precursor to give the high pH fluid. In operation with the ACT having the solid precursor therein, as water permeates through the ACT polymer, the water reaches and hydrates the solid precursor to generate the inclusion of high pH fluid that will initiate degradation of the ACT polymer.

In other cases, the solid precursor (e.g., solid sodium hydroxide, etc.) is placed proximate to the ACT polymer of the downhole tool 108 and hydrates near the polymer. The solid precursor could be part of the downhole tool 108 and be placed in the wellbore as part of the installation of the downhole tool 108. The result is a high pH fluid proximate the polymer of the downhole tool 108 and degradation is initiated. Again, solid precursors to the high pH fluid include sodium hydroxide, potassium hydroxide, calcium hydroxide, and the like.

In the illustrated implementation, the wellbore 102 has the casing 104 and is therefore a cased wellbore. Cement (not shown) may be disposed between the casing 104 and the formation 110 face. The formation 110 face can be considered a wall of the wellbore 102. The casing 104 may be secured within wellbore 102 by the cement. The casing 104 (e.g., metal) may may be expanded or unexpanded as part of an installation procedure.

Perforations may be formed through the casing 104 (and cement) for entry of fluid (e.g., hydrocarbon, water, etc.) from the subterranean formation 110 into the wellbore 102 to be produced (routed) as produced fluid through the production tubing 106 to the surface 112. A perforating gun may be sent down the wellbore 102 to blast holes (perforations) in the casing 104. The surface equipment 114 may include a wellhead for receipt of the produced fluid. In other implementations, the wellbore 102 can be utilized for injection of fluid from the surface 112 through the wellbore 102 and the perforations in the casing 104 (and cement) into the subterranean formation 110. The surface equipment 114 can include equipment (e.g., pumps, vessels, vehicles, etc.) for hydraulic fracturing of the subterranean formation via the wellbore 102.

The surface equipment 114 can include a hoisting apparatus (e.g., for raising and lowering pipe strings) and a derrick. The surface equipment 114 and equipment deployed in the wellbore 102 can include a wireline, slickline, coiled tubing, tubing string, pipe, drill pipe, drill string, and the like, that facilitates mechanical conveyance for deploying downhole tools (e.g., downhole tool 108 and other tools). The deployment of the downhole tool 108 may include lowering the downhole tool 108 into the wellbore 102 from the surface 112 and setting (e.g., via mechanical slips or other mechanisms) the downhole tool 108 in the wellbore 102. In some implementations, the equipment (e.g., wireline) may provide electrical connectivity, for example, to actuate the downhole tool 108. For example, a packer or plug may be actuated to seal off a portion of the wellbore 102. The downhole tool 108 as installed in the wellbore 102 may be permanently set, mechanically set, or hydraulically set, or any combinations thereof. The downhole tool 108 as a plug (e.g., frac plug, bridge plug, etc.) may be set to isolate a lower part of the wellbore 102.

Frac plugs are employed to isolate zones in a wellbore for hydraulic fracturing. A frac plug may play a significant role (during hydraulic fracturing) to isolate different zones of the wellbore 102. Hydraulic fracturing (fracking) is a well stimulation technique which involves fracturing bedrock structures of the subterranean formation 110 by high pressure liquids to improve the production of the well having the wellbore 102. The frac plug being a dissolvable polymer composite can be beneficial to speed the hydraulic fracturing operation and as an effective solution (being lightweight and dissolvable) for running in a horizontal wellbore. Considering the increasing in the length of the lateral wells, extended milling of frac plugs not dissolvable in the horizontal wellbore can be a challenge and has generally not yet been considered feasible for farthest rock bottom of wellbores.

A bridge plug may be installed to seal the wellbore 102 and/or to perform work on the wellbore 102. Bridge plugs are downhole tools that can be located in the wellbore 102 and set to isolate the lower part of the wellbore 102 (further downhole). The bridge plug is generally run in hole and set to isolate a lower zone of the wellbore 102 from an upper zone of the wellbore 102. Bridge plugs may facilitate the lower wellbore to be sealed from production or temporarily isolated from a treatment conducted on an upper zone of the wellbore 102.

A bridge plug can include slips (e.g., mechanical slips), a mandrel, and sealing element (e.g., expandable, elastomer, rubber, etc.). A bridge plug may be run (e.g., run on a wireline or pipes, and/or through a tubing string) and set (e.g., set in casing 104 or tubing 106) to isolate a lower zone of the wellbore 102 while an upper section of the wellbore 102 is tested, cemented, stimulated (e.g., hydraulically fracturing of the subterranean formation 110), produced (e.g., hydrocarbon and/or water produced from the subterranean formation 110 through the wellbore 102), or injected (injection from surface 112 through the wellbore 102 into the subterranean formation 110). The bridge plug may isolate the upper zone from the lower zone, preventing or reducing fluids of the lower zone (downhole of the plug) from reaching an upper zone (uphole of the plug) of the wellbore 102. Again, such isolation may exist while the upper zone (section) is tested, cemented, stimulated, produced, or injected either permanently or temporarily within the wellbore 102.

The downhole tool 108 as a packer may be a device that can be run into the wellbore 102 with a smaller initial outside diameter that then expands externally to seal the wellbore 102. Packers may employ flexible, elastomeric elements that expand. A packer may be a production packer, test packer, isolation packer, etc. A production packer may isolate the annulus (e.g., between the production tubing 106 and the casing wellbore 102 wall) and anchor or secure the bottom of the production tubing string. A typical packer assembly secures the packer against the casing 104 or liner wall, such as by a slip arrangement of the packer, and creates (forms) a hydraulic seal via sealing elements (e.g., an expandable elastomeric element) of the packer to isolate the annulus. The tool mandrel (and other components) of the packer (and of the frac plug, bridge plug, etc.) can be the ACT composite as discussed.

When set, the downhole tool 108 if a packer or plug may fluidically isolate the lower part of the wellbore 102 (downhole of the packer or plug) from an upper part of the wellbore (uphole of the packer or plug). When set, the downhole tool 108 as a packer may isolate zones of the annulus between the casing 104 and the production tubing 106 (e.g., a tubing string) by providing a seal (fluid seal) between the production tubing 106 and the casing 104. Again, in examples, a packer if the downhole tool 108 may be disposed on the production tubing 106.

It should be understood by those skilled in the art that present implementations are equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an onshore operation, it should be understood by those skilled in the art that the present techniques are applicable for offshore operations. In addition, while FIG. 1 depicts use of the downhole tool 108 in a cased portion of wellbore 102, it should be understood that a downhole tool 108 may also be used in uncased portions (e.g., openhole portions) of wellbore 102.

While implementations of ACT herein may degrade in presence of high pH fluid, those implementations of the ACT resin not in the presence of high pH fluid can be stable in air to at least 350° C. and will generally not thermally degrade at temperatures below 500° C. The high $T_g$ characteristic of this thermosetting copolyester polymer matrix can be up to 307° C. or up to 350° C. Examples of the ACT have excellent resistance to chemicals except to fluids (strong base) with a high pH near or at 14.

Examples of compounds in embodiments of the ACT resin are chemically resistant (with negligible change in mass, dimension, and properties of the ACT exposed to these compounds) include acetic acid, acetone, benzene, chlorine, chlorine/water, dimethylformamide, dioxane, ethanol, ethyl acetate, ethylene glycol, fluorinated refrigerants, formic acid, hexanes, hydrogen chloride (pH=1), isopropanol lubricants, N-methylpyrrolidone (NMP), methanol, methylene chloride, mineral oil, nitric acid (50%), octane, phenol, silicone oil, tetrahydrofuran, toluene, and water. Again, the ACT being chemical resistant is characterized as the ACT having negligible or immeasurable change in dimension, mass, and/or properties. This ACT is not chemically resistant to exposure to a strong base (e.g., pH=14). Thus, the ACT is vulnerable to chemical attack (degradation) by strong bases generally with pH=14 and to moderately strong bases with pH between 11 and 13. This vulnerability is beneficial for employment of this ACT as degradable or dissolvable material.

Figure 2:
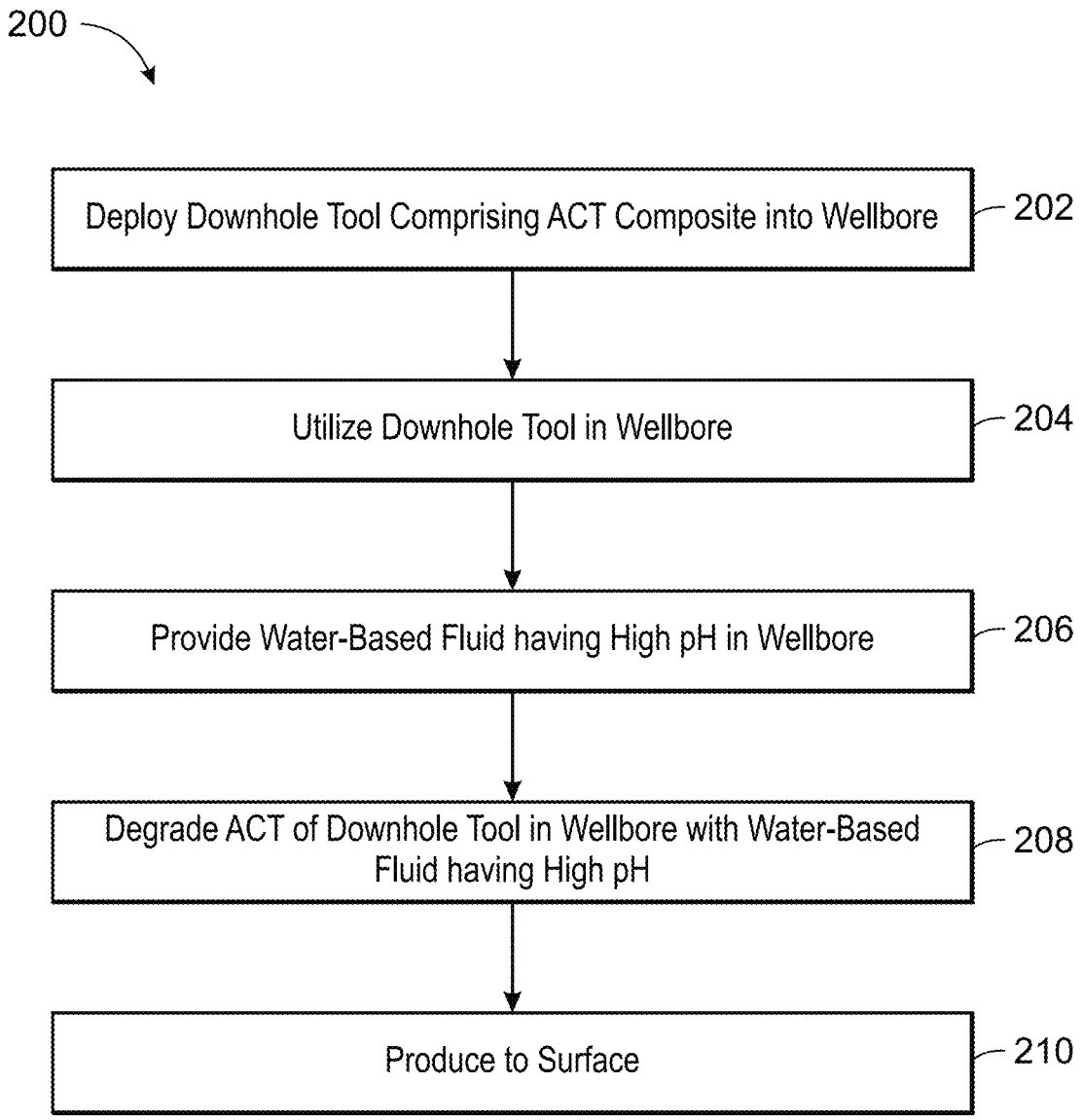
FIG. 2 is a block flow diagram of a method of applying a downhole tool.

FIG. 2 is a method 200 of applying a downhole tool. The downhole tool is or includes an ACT composite that is a composite of an ACT and a reinforcement material. The glass transition temperature of the ACT is at least 150° C. The ACT may be an ACT vitrimer.

At block 202, the method includes deploying the downhole tool into a wellbore (e.g., wellbore 102 of FIG. 1) formed in a subterranean formation. See the related discussion associated with FIG. 1. The deployment may include lowering the downhole tool from the Earth surface into the wellbore, such as to a desired or specified location (e.g., depth, etc.) in the wellbore. The deploying of the downhole tool may generally include installing (e.g., setting, etc.) the downhole tool at the specified location in the wellbore At block 204, the method includes utilizing the downhole tool in the wellbore, such as for its intended use or purpose. The operational utilization and configured use of the downhole tool depends on the type of downhole tool. See examples of downhole tools and their use discussed with respect to FIG. 1. For instance, the downhole tool as a packer may be utilized in operation to form a hydraulic seal (e.g., in the annulus between production tubing and the wellbore casing) to fluidically isolate the annulus in a lower part of the wellbore from the annulus in an upper part of the wellbore.

At block 206, the method includes providing a water-based fluid having a high pH in the wellbore to degrade the ACT of the downhole tool for removal of the downhole tool from the wellbore. The water-based fluid (an aqueous fluid) having high pH may also be called a high pH dissolution fluid. The pH of the water-based fluid may be, for example, at least 11, at least 12, at least 13, or at least 14. The water-based fluid (an aqueous fluid) having the high pH may be or include, for example, lithium hydroxide (LiOH), sodium hydroxide (NaOH), potassium hydroxide (KOH), rubidium hydroxide (RbOH), cesium hydroxide (CsOH), calcium hydroxide [$Ca(OH)_2$], strontium hydroxide [$Sr(OH)_2$], or barium hydroxide [$Ba(OH)_2$], or any combinations thereof.

In implementations, the providing of the water-based fluid may involve pumping the water-based fluid having the high pH from the surface into the wellbore. In implementations, the providing of the water-based fluid may involve providing a solid precursor (e.g., solid NaOH, solid KOH, solid $Ca(OH)_2$, etc.) into the wellbore, thereby combining the solid precursor with wellbore fluid giving the water-based fluid having the high pH in the wellbore.

At block 208, the method includes degrading ACT of the downhole tool in the wellbore with the water-based fluid having high pH. Thus, the method includes providing (block 206) the water-based fluid having high pH, thereby degrading (block 208) the ACT of the downhole tool in the wellbore with the water-based fluid having high pH. The degrading may include dissolving the ACT.

At block 210, the method may include producing the downhole tool as degraded to the surface. In implementations, the downhole tool ACT if dissolved may flow, for example, as dissolved with produced fluid (e.g., including wellbore fluid, etc.) to the surface. Any portions of the downhole tool not dissolved, such as reinforcement material (fibers, particles, etc.), undissolved ACT fragments, and other components, may flow as solid with the wellbore fluid or other produced fluid to the surface in being produced. In implementations, the fluid as produced may be processed at the surface to separate the degraded downhole tool from the fluid.

Thus, for removal or displacement of the downhole tool from the wellbore, the downhole tool may be subjected (block 206) to a high pH fluid to degrade (block 208) the downhole tool or components of the downhole tool. After degradation (e.g. dissolution) of the downhole tool or component(s) of the downhole tool, the degraded or dissolved material may, for example, be produced (block 210) with wellbore fluid from the wellbore to the surface. Any residual material of the downhole tool not dissolved may flow (block 210) with wellbore fluid to the surface and be separated (if desired) from the wellbore fluid as produced at the surface.

Figure 3:
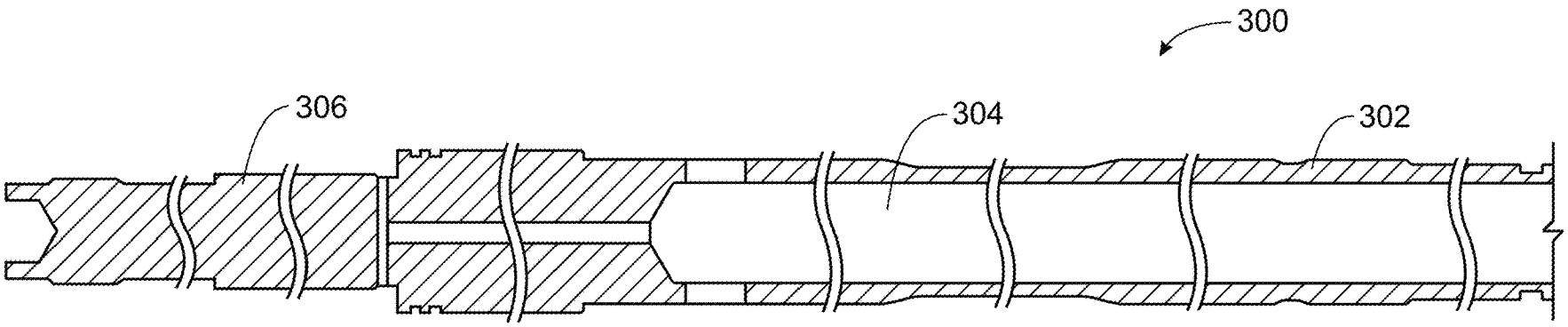
FIG. 3 is a diagram of an example of a dissolvable tool mandrel for a downhole tool that is an example bridge plug.

FIG. 3 is an example of a dissolvable tool mandrel 300 for a downhole tool that is an example bridge plug. The tool mandrel 300 can be a composite of ACT and filler material, and with the ACT that is dissolved in presence of fluid having a pH of at least 11, at least 12, at least 13, or at least 14. The depicted tool mandrel 300 for an example bridge plug is given only as an example. A dissolvable tool mandrel that can be composite of ACT and filler material is applicable for other bridge plugs and for other downhole tools that are not a bridge plug.

In the illustrated embodiment, the tool mandrel 300 is generally cylindrical (a radial cross-section that is generally circular). The tool mandrel 300 as a dissolvable mandrel for a bridge plug is utilized in a borehole (wellbore). The depicted view is a cross section (longitudinal cross section) with the cutting plane parallel to the longitudinal axis.

The tool mandrel 300 has a wall 302 and an internal cavity 304. The wall 302 varies in wall thickness along the longitudinal length of the wall 302. In other words, the wall 302 varies in wall thickness along the longitudinal length of the tool mandrel. The tool mandrel 300 structure has a solid portion 306 with no internal cavity in a radial direction.

Figure 4:
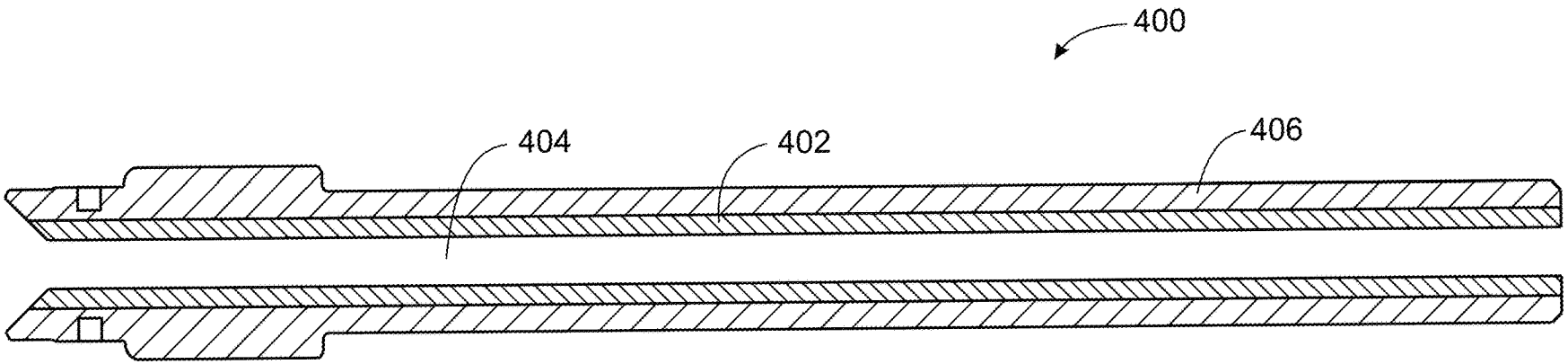
FIG. 4 is a diagram of an example mandrel configuration of a downhole tool, and in which the downhole tool in an example frac plug.

FIG. 4 is an example mandrel configuration 400 of a downhole tool. In this implementation, the downhole tool is an example frac plug. The illustrated mandrel configuration 400 includes a dissolvable inner mandrel 402 (having an internal cavity 404) and a dissolvable outer mandrel 406. The outer mandrel profile may be formed on the inner mandrel 402. The dissolvable mandrels 402, 406 may each be a composite of ACT and filler material, as discussed. The mandrels 402, 406 are each generally cylindrical (a radial cross-section that is generally circular). The mandrels 402, 406 as together in combination may be considered a single hollow profile having the internal cavity 404. As indicated, the example mandrel configuration 400 is for an example frac plug utilized in a borehole (wellbore). The depicted view is a longitudinal cross section.

The term "downhole" may mean inside a well, such as in a borehole or wellbore formed through the Earth surface into a subterranean formation (geological formation) in the Earth crust. Downhole equipment, such as and downhole tools, may be equipment that is utilized in the borehole or wellbore. Downhole tools are conventionally mostly constructed with metals that can be prone to significant corrosion in the presence of downhole fluids. Hydrogen sulfide ($H_2S$), for example, in downhole fluids can be especially corrosive when aggravated at elevated temperature. Corrosive downhole fluids can include, for example, hydrogen ($H_2$), carbon dioxide ($CO_2$), brines, etc. However, embodiments herein of dissolvable ACT-reinforced composite downhole tools are generally resistant to $H_2S$, $H_2$, $CO_2$, brines, and water in experiencing less than 6 weight percent loss of mass upon exposure of the ACT-reinforced composite to these compounds for one year at 150° C.

Conventional non-metallic composites with thermosetting epoxies are operational at typical downhole temperatures but are thermally stable generally only up to 120° C. for long-term usage. Even high-temperature polymeric systems (e.g., polyimides, bismaleimides, and phenyl-based epoxies) including high-performance thermoplastics [e.g., polyether ether ketone (PEEK) and polyether ketone ketone (PEKK)] have a glass transition temperature less than 150° C.

As mentioned, in embodiments, the ACT (e.g., as an aromatic thermosetting copolyester) includes an aromatic polyester backbone. The ACT may be formed by crosslinking oligomers. The oligomers and the formed ACT may be carboxylic acid-capped (capped with a carboxylic acid functional group as end group) or acetoxy-capped (capped with an acetoxy functional group as an end group). The crosslinked network may be composed of an aromatic polyester backbone interconnected via covalent single and double oxygen bonds. The ACT matrix can be generally amorphous. The percent crystallinity may be, for example, in the range of 0% (no crystallinity) to 6%.

An increase in the operating envelope (e.g., increased temperature) for polymers that can be utilized for composites in downhole oil-and-gas applications can be beneficial. Embodiments herein disclose ACT (e.g., aromatic thermosetting copolyester) having $T_g$ up to 307° C. [e.g., 150° C. to 307° C., 170° C. to 307° C., 267° C. to 307° C., etc.] utilized as a solution for high-temperature well conditions. This present high-temperature polymeric system of ACT may be beneficial for different non-metallic well completion tools including tool mandrels, tool casings, tubing, pressure housings, valve bodies, plugs, and others.

Figure 5:
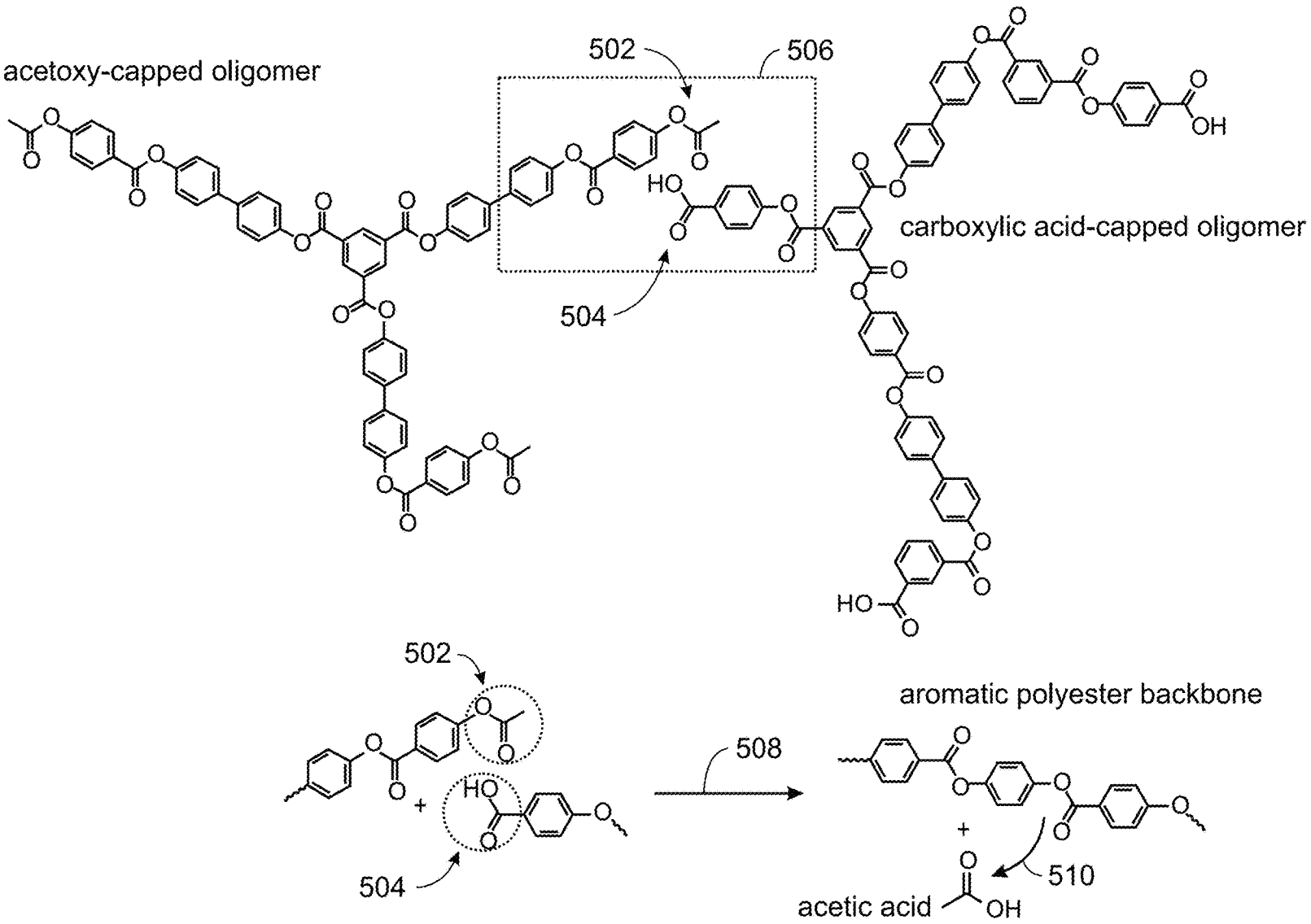
FIG. 5 is a diagram that depicts transesterification of ester bonds.

FIG. 5 depicts transesterification of ester bonds of implementations of the ACT, such as an aromatic thermosetting copolyester, in the forming (formation) of the ACT where the function group of the ester polymer are converted and where the reaction time is accelerated through the utilization of a pH-based catalyst. Depicted is an example of ACT vitrimer that can be utilized as dissolvable for a downhole tool. The ACT can be a vitrimer (ester-bond containing copolyester resin) that crosslinks like a thermoset but can be reprocessed like a thermoplastic. The ACT may be an uncatalyzed, condensation cure polymer system that is amorphous but can have liquid crystal segments.

Embodiments may utilize ester bonds to produce ACT as degradable polymers. Ester bonds are widely used as a reversible linkage. Depicted are an acetoxy-capped oligomer having an acetoxy functional group 502 and a carboxylic acid-capped oligomer having a carboxylic acid functional group 504. The two functional groups 502, 504 of the two oligomers, respectively, interface as indicated by the dashed box 506. The two oligomers react 508 undergo transreaction to give the ATSP having an aromatic polyester backbone. Acetic acid is released, as indicated by arrow 510. In implementations, a high pH fluid may be subsequently utilized for hydrolysis reaction to occur for polymer dissolution.

Figure 6:
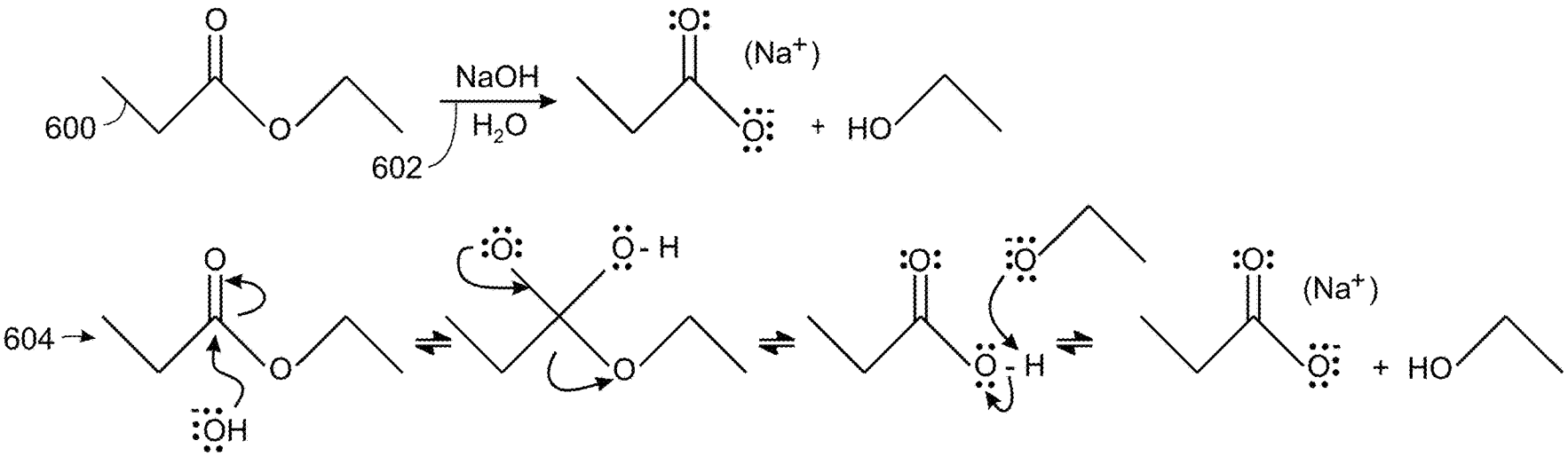
FIG. 6 is a diagram of an example degradation mechanism.

FIG. 6 depicts an example degradation mechanism of ACT 600. The depicted ACT 600 has an aromatic polyester backbone and may be formed (produced) as discussed with respect to FIG. 5. The degradation mechanism may be by base catalyzed hydrolysis 602 of esters. Equilibriums 604 are shown.

The ACT vitrimer having ester bonds may be degraded via strong bases. Herein, the ester bonds are cleavable relying on base catalyzed hydrolysis of esters. This can be with the ACT, for example, as carboxylic acid cured, anhydride cured, and others. The strong bases utilized can be, for example, LiOH, NaOH, KOH, RbOH, CsOH, $Ca(OH)_2$, $Sr(OH)_2$, $Ba(OH)_2$, and so on. Fluid available downhole, e.g., brines like high-concentration solution of salt sodium chloride or calcium chloride etc., can be utilized with the pH of the fluid adjusted to trigger the degradation of the ACT.

Different compositions of ACT vitrimer can be specified giving different density of ester bonds to facilitate in-demand degradation based on the specific downhole conditions. While utilizing strong bases for degradation are discussed herein, other solvents like benzyl alcohol, polyethylene glycol (PEG200)/NaOH system, ethylene glycol, solvent mixture (N-methyl-2-pyrrolidone (NMP) and ethylene glycol) using a highly efficient organic catalyst 1,5,7-triazabicyclo [4,4,0]dec-5-ene (TBD) can be applied for degradation purposes. Vitrimers may include catalyst for triggering dynamic transesterification. These catalysts can include, for example, metal catalyst ($Zn(Ac)_2$), organic catalyst 1,5,7-triazabicyclo [4,4,0]dec-5-ene, and other catalysts.

The present disclosure provides for the applicability of ACT (e.g., aromatic thermosetting copolymer) in the oil-and-gas domain. Embodiments provide ACT as a material solution to manufacture dissolvable downhole tools as an alternative to metallic downhole tools and conventional thermoset or thermoplastic materials for composite hollow profiles and tools. As discussed, embodiments herein include dissolvable composite downhole tools that can be manufactured from ACT resin with reinforcement (e.g., fiber). The reinforcement can include, for example, carbon, glass, boron, aramid, etc. The aramid can be an aromatic polyamide, such as Kevlar®. The dissolvable composite as reinforced ACT withstands relatively high downhole temperatures (e.g., up to 300° C.).

While the discussion herein has focused on ACT vitrimer as a resin or polymer for the resin matrix (binder) in a dissolvable composite downhole tool, other vitrimers can be applicable in implementations as resin in a dissolvable composite downhole tool. Such vitrimers may include, for example, acetal epoxy based vitrimer, Schiff base epoxy vitrimer, disulfide based vitrimer, polyhexahydrotriazine (PHT) based vitrimer, boronic ester based vitrimer, benzoxazine based vitrimer, and other vitrimers.

Embodiments utilize ACT to manufacture composite downhole tools (or downhole tool components) for oil and gas applications. While forming flat composite laminates from ACT resin may be applicable, present embodiments provide for the forming of composite hollow profiles and other geometries from ACT resin for downhole. Embodiments may utilize prepreg tapes made from ACT resin for filament winding, tape layup and allied processes to manufacture composite downhole tools or downhole tool components for downhole applications in a wellbore or borehole.

The ACT has both thermoset and thermoplastic behaviors, relatively high operating temperature, and good chemical compatibility. The ACT may be utilized as the matrix and as the binder in a composite structure. The terms "matrix" and "binder" can be synonyms in the context of the present ACT composite.

ACT is a material that can behave as a thermoset (e.g., before processing) and once cured, the ACT can behave like a thermoplastic. Thermoplastic nature in ACT behavior is generally after curing. In implementations, the ACT (e.g., aromatic thermosetting copolymer) prepreg tapes are generally a thermoset prepreg tape. In implementations, the ACT prepreg tapes are generally a vitrimer prepreg tape. Vitrimers are a class of plastics derived from thermosetting polymers, may be very similar to thermosetting polymers, and may include molecular covalent networks that can change their topology by thermally activated bond-exchange reactions.

Many conventional downhole tools like mandrels, tool casings, tubing, pressure housings, valve bodies, plugs, etc. are metallic while some are non-metallic having a relatively low operation envelope with respect to temperature limiting their use in high temperature, high pressure applications. As discussed, implementations provide ACT composites as replacement material for metal of downhole tools operating in high temperature-high pressure downhole environments, and with the ACT as dissolvable in response to presence of high-pH fluid. The ACT polymer matrix as a binder/resin can be utilized with different reinforcement materials (e.g., carbon, glass, Kevlar®, hybrid, and others). Towpregs, commingled fibers, and similar constructions can be made from the ACT polymer matrix (e.g., available in powder form). The towpregs can then be employed to manufacture downhole tool components via filament winding, tape placement and allied processes. Simple hand layup and bladder molding can also be applied to manufacture downhole tool components from continuous fiber prepregs made from this ACT resin system. The composite downhole tool components realized through this ACT material system can have capability to withstand relatively high temperatures including in a continuous service temperature of up to 300° C. (and greater), which is significantly higher than typical high-temperature thermoplastic and thermoset resin systems. As indicated, the composites with ACT resins discussed herein can be stable in air to at least 350° C. and stable in nitrogen to at least 425° C. This ACT resin system generally does not thermally degrade at temperatures below 500° C.

Aromatic thermosetting copolymer is a material that is generally continuously amorphous but can have liquid crystal segments. Aromatic thermosetting copolymer can give a hybrid of properties. In particular, aromatic thermosetting copolymer can have combined properties that include both typical thermoset properties and additionally thermoplastic properties, or in other words, is a vitrimer as discussed. In post curing of the aromatic thermosetting copolymer after the crosslinking, the aromatic thermosetting copolymer (including aromatic thermosetting copolymer composites) may behave as a thermoplastic and receptive to being thermoformed, joined, welded, recycled, and the like.

In implementations, the ACT composite may be a hollow profile of certain downhole tools. A hollow profile is generally a structure having a wall (with a wall thickness) and an interior cavity. The interior cavity is an internal space (volume) congruent with the profile being a hollow profile. The inside surface of the wall may define the interior cavity. The hollow profile shape may enclose the interior cavity (internal space) as a void. The interior cavity may be enclosed (e.g., fully enclosed) by the wall. The interior cavity may be enclosed in a radial direction by the wall but not enclosed at longitudinal ends of the hollow profile. The hollow profile can be generally cylindrical with a circular cross section (cutting plane parallel to radial axis and perpendicular to longitudinal axis). On the other hand, a cross section (cutting plane parallel to radial axis and perpendicular to longitudinal axis) of the hollow profile may be, for example, square, rectangular, or irregular.

In implementations, the downhole tool can include the hollow profile as tubing, piping, a pressure housing, a valve body, or a tool mandrel, or any combinations thereof. For instance, the downhole tool may have a mandrel (tool mandrel) including the hollow profile, and thus wherein the hollow profile may be a mandrel of the downhole tool. In these implementations, the downhole tool may be, for example, a packer, a plug (e.g., frac plug, bridge plug, etc.), or an instrument assembly. In implementations, the downhole tool can be or include a pressure housing comprising a hollow profile that is an ACT composite.

Embodiments of the downhole tool 108 in FIG. 1 may be or include an ACT composite hollow profile that is dissolved in the presence of high pH fluids. Examples of such hollow profiles for use in a borehole (e.g., wellbore 102 of FIG. 1) include a tubular, tool casing, tubing (a tube), piping (a pipe), a pressure housing, a valve body, a tool mandrel, and so on. The tubing, piping, pressure housing, valve body (of a valve), tool mandrel, and the like, may be a component of a downhole tool. The downhole tool having the hollow profile as a mandrel may be, for example, a plug (e.g., frac plug, bridge plug, etc.), a packer, a gauge mandrel, and so forth. A pressure housing as the downhole tool or component of the downhole tool as the hollow profile may be, for example, for instrumentation or other applications. A host of different downhole tools may incorporate a mandrel, tubing, piping, a valve body, a pressure housing, etc. that is a hollow profile. The downhole tool may be the hollow profile, or the hollow profile may be a component of the downhole tool.

A component of a downhole tool as a plug, packer, gauge mandrel, or instrumentation (instrumentation assembly) may be a mandrel that is a hollow profile. The downhole tool may be or have a pressure housing as a hollow profile. Downhole tubing and piping (e.g., as a component of or associated with the downhole tool) can be a hollow profile. The valve body of a valve may be a hollow profile. Again, the hollow profile may be a composite hollow profile that is a composite of ACT and reinforcement material (e.g., fibers, particles, etc.), such as the composite hollow profile having about 10 wt % to about 80 wt % of the reinforcement material. The weight percent of the reinforcement material in the ACT composite may be outside this numerical range.

As indicated, reinforcement material to manufacture the composite downhole tool or downhole tool components can be particles (e.g., carbon, glass, etc.) or fibers. The fibers can be carbon fibers, glass fibers, aramid fibers (e.g., Kevlar® fibers), basalt fibers, natural fibers, etc., or any combination of these fibers as reinforcement materials. The ACT (ACT vitrimer) can be the matrix material to make, for example, a unidirectional vitrimer prepreg with post cured thermoplastic characteristics (e.g., in the forms of sheets or tapes, or a towpreg) and in which the ACT acts as the resin system. "Prepreg" is a common term for a reinforcing fabric which has been pre-impregnated with a resin system. A prepreg may mean "fiber pre-impregnated with resin." Prepregs can be utilized to form (manufacture) composites (e.g., structural composites). Herein, in context of ACT vitrimer prepreg, vitrimer are a class of plastics, which are derived from thermoset polymers and are very similar to thermoset polymers, and may include molecular covalent networks that can change their topology by thermally activated bond-exchange reactions.

A prepreg is generally fiber material (e.g., woven or unidirectional fibers) impregnated with matrix material (e.g., a resin). The prepreg is typically formed before application to manufacture a product with the prepreg. Therefore, impregnated fibers in the prepreg (e.g., formed well before application of the prepreg) may be called pre-impregnated.

ACT is applicable as the resin for the prepreg as a vitrimer prepreg. Because of vitrimer behavior of ACT (e.g., aromatic thermosetting copolymer), the ACT (even though a thermoset) can act as the matrix material with thermoplastic behavior in what can be labeled as a vitrimer prepreg. Thermoplastic behavior can be resins that soften or become moldable on heating and harden on cooling, and are able to repeat these processes.

ACT vitrimer prepregs have fibers (e.g., woven, non-woven, knitted, stitched, braided, wound, etc.) and can be in the form, for example, of sheets or tapes, or other forms. In implementations, the fibers may generally be continuous fibers. The prepreg (e.g., in form of sheets or tapes) may be unidirectional fibers (most or all fibers running the same direction) impregnated with a resin matrix. Filament winding may be employed to form composite structures from the prepreg.

A towpreg (also called tow prepreg) is a form of prepreg (e.g., generally having continuous fibers). Towpreg is tows of fiber pre-impregnated with resin. Towpreg is commonly utilized in filament winding applications. Towpreg material can be essentially a continuous prepreg composite and can have a relatively high filament count. Towpreg winding may utilize a fiber tow that is pre-impregnated with resin (prepreg). For unidirectional tape, individual tows may aligned and then spread to form an impregnated unidirectional tape. For woven, individual tows may woven together to form a fabric before impregnation. For non-woven, tows may be arranged in a non-woven mat before impregnation.

Filament winding is a composite manufacturing technique that can involve applying filament tows (e.g., glass fibers, carbon fibers, etc.) onto a mandrel. The filament layers may be cross plied to achieve the strength characteristics determined by the part designer. The applied tows can be combined with a resin matrix immediately prior to application to the mandrel (wet winding) or the tows can be a prepreg or towpreg which is the fiber/resin combination typically made well before application.

Different manufacturing techniques can be utilized to make the ACT composite. The ACT composite formed can be a downhole tool or a component of a downhole tool. An example manufacturing technique that can be utilized to make the downhole-tool component profiles is filament winding. Other manufacturing techniques, such as tape placement or bladder molding, can also be used to manufacture the composite downhole-tool component profiles. The ACT composite for the downhole tool can be formed, for example, by filament winding or bladder molding.

For tape placement, a tape (e.g., a single tape) may passed through the feed rollers with a predefined tension and feed rate. The tape placement for composites (e.g., thermoplastic composites) may involve heating, melting, and cooling. An incoming composite tape may be bonded to a previously laid and consolidated laminate under heat and pressure locally applied to the interface. By laying additional layers in different directions, a part with desired thickness and properties can be fabricated. An example of tape placement is automated tape placement (ATP) composite manufacturing. In examples, the fiber placement process automatically places multiple individual pre-impregnated tows onto a mandrel at relatively high speed, employing a numerically controlled placement head to dispense, clamp, cut and restart each tow during placement. Tape laying is with prepregged tape, rather than single tows, laid down (e.g., continuously) to form parts.

Bladder molding is a manufacturing technique for composite parts (e.g., hollow composite parts). In bladder molding, a composite material may be applied to a bladder and the part inserted into a female cavity mold. A press may clamp the mold shut and heat applied to cure the part. Applied air pressure can force the laminate outward in the cavity, consolidating the material in the closed mold. The bladder may be removed after cure and the remaining end product is a hollow structure.

The bladder molding may begin with fibers (e.g., sheets of fibers) impregnated with ACT and that can be a prepreg. The prepreg sheets may be wrapped around an inflatable bladder, and then placed inside the mold cavity and the mold closed. Once the mold is closed, the mold may apply pressure to the inside of the bladder. Pressure may cause the bladder to expand and push on the resin-filled fibers. The pressure pushes outward against the inside of the mold cavity. Then, heat may be applied to the mold to solidify the part, or also known as curing. The component fibers form in the shape of the inside the mold cavity. Once cured, the mold may be opened, revealing the hardened hollow part, and the bladder may be removed from the inside.

Figure 7:
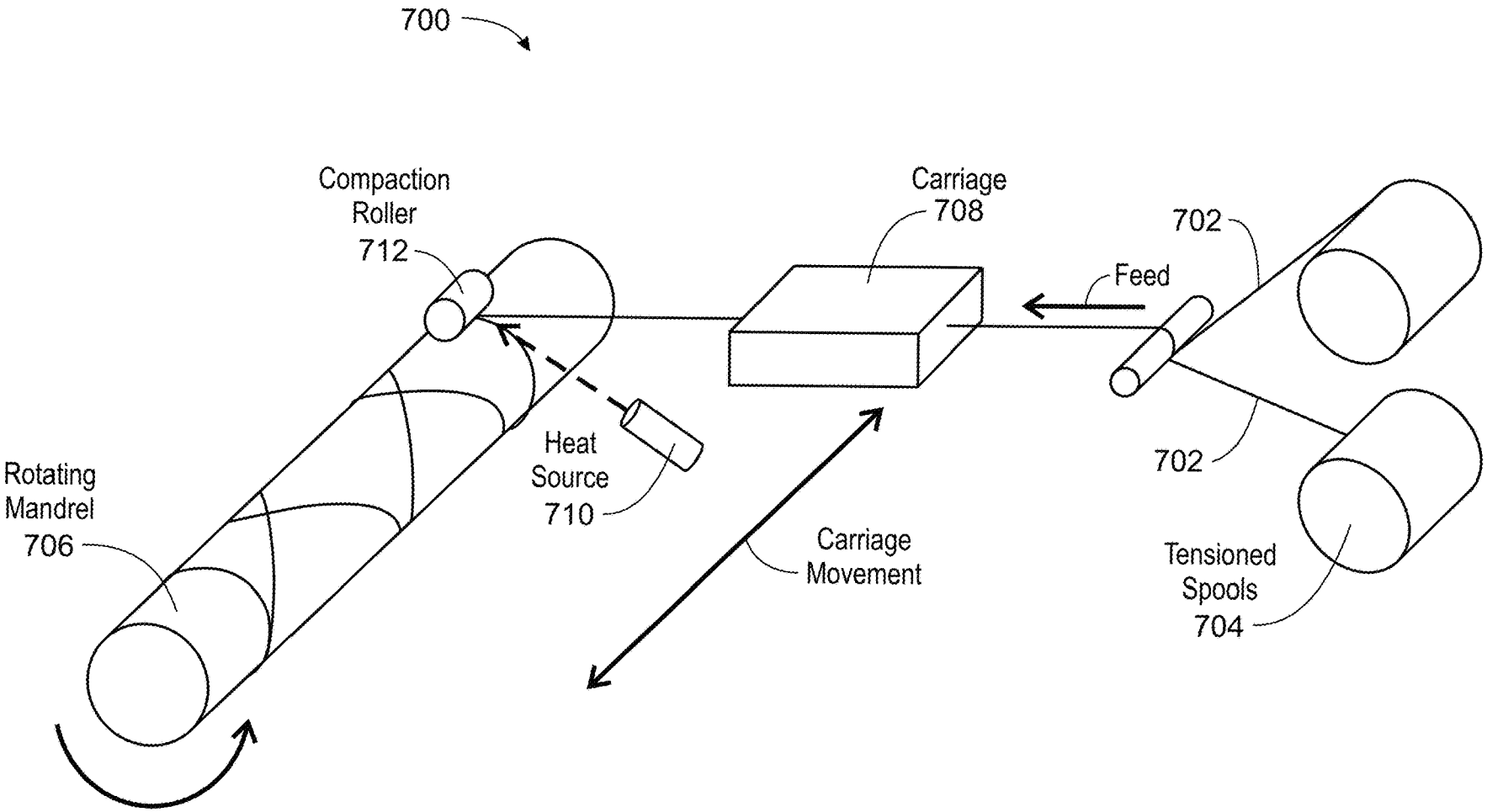
FIG. 7 is a diagram of a filament winding system.
Figure 8:
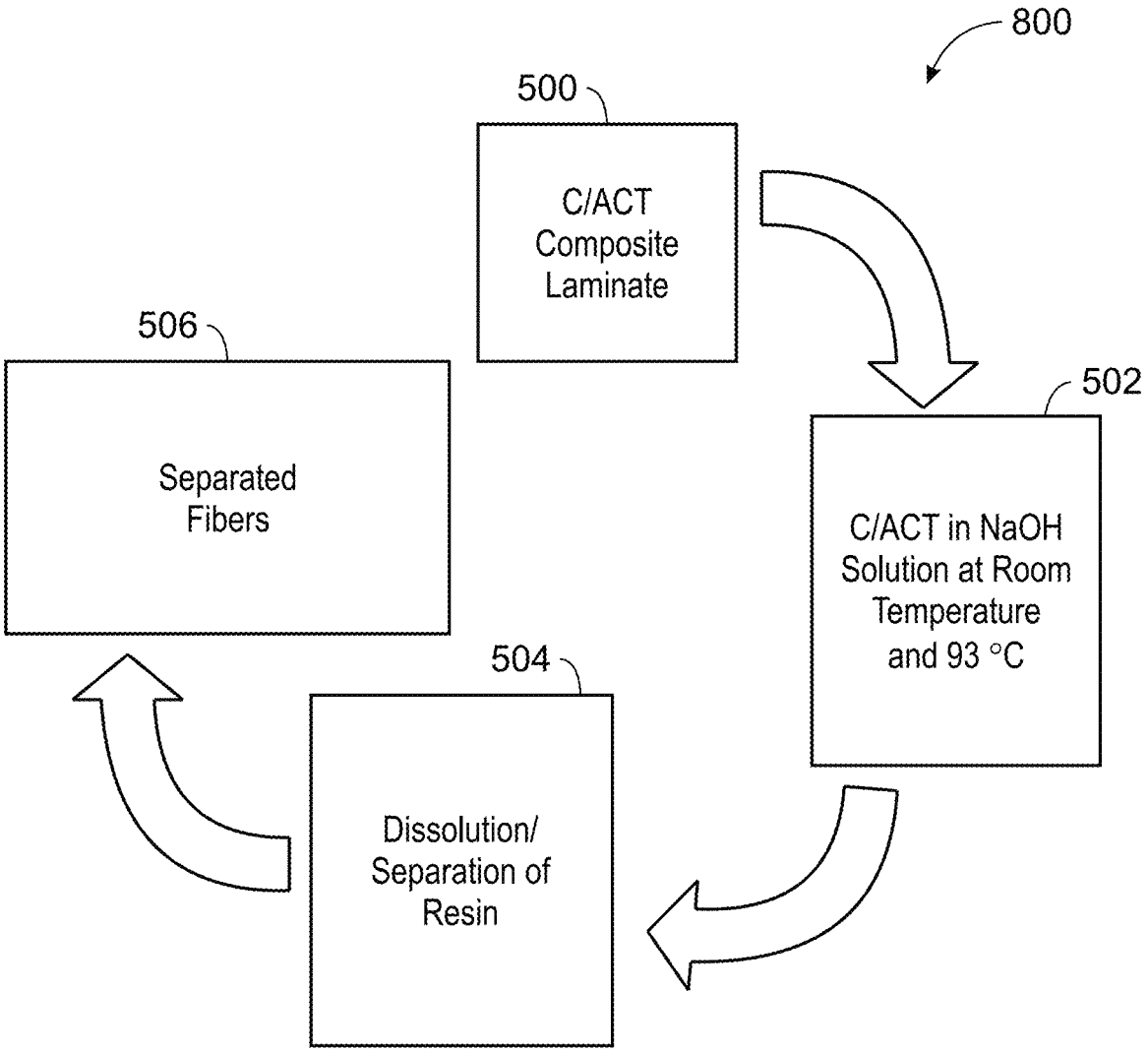
FIG. 8 is a diagram of degradation process steps of a composite being immersed in a highly basic solution in the Example.

FIG. 7 is a filament winding system 700. Filament winding can be employed to manufacture the ACT composite structure (e.g., as a hollow profile) for a dissolvable downhole tool, for example, with prepreg tapes or towpregs. The fiber angles can be varied to produce tailored laminates to meet a range of loads requirement for a particular product. In embodiments, the product of the filament winding may be a dissolvable ACT composite structure (e.g., the overall form of the structure as a hollow profile) for a dissolvable downhole tool.

The feed 702 can include fibers impregnated with ACT resin, such as in the form of prepreg tapes or towpregs. As discussed, the fibers can include, for example, glass fibers, carbon fibers, aromatic polyamide fibers (e.g., Kevlar fibers), and/or other fibers. The feed 702 (ACT-impregnated fibers) can be fed, for example, from tensioned spools 704. The ACT-impregnated fibers can be wound on a rotating metallic mandrel 706 to manufacture an ACT composite (fiber-reinforced) structure as or for a dissolvable downhole tool. The filament winding system 700 may include a carriage 708 that facilitates guiding the winding in the forming of the ACT composite product structure on the rotating mandrel 706. In examples, no additional pressure is typically implemented for compaction because of the tension maintained on the fibers/tapes during the filament winding. The ACT composite formed as the structure on the mandrel 706 can be cured, for example, in an oven or autoclave, or similar equipment, after the winding is completed. The peak cure temperature may be, for example, in the range of 250° C. to 350° C., or in the range of 270° C. to 330° C. The cure time (e.g., the time of the ACT composite in the oven or autoclave) may be, for example, in the range of 60 minutes to 240 minutes, While conventional filament winding can be utilized, in-situ consolidation using a heat source 710 (e.g., conduction heater, convection heater, ultrasonic heater, infrared heater, eddy current heater, or laser) and a compaction roller 712 can also be relied on to apply heat and pressure, respectively. The heat source 710 may apply heat to the ACT-impregnated fiber being wound onto the rotating mandrel 706. The compaction roller 712 may apply pressure to the ACT-impregnated fiber being wound onto the rotating mandrel 706. In implementations, this application of heat and pressure can provide for substantially uniform impregnation and facilitate more control of the fiber volume fraction. Thus, the filament winding system 700 may include heat source 710 and the compaction roller 712 that facilitate forming of the ACT composite formed structure on the rotating mandrel 706.

A full composite cylindrical structure (no liner) can be made by demolding the composite (tube) from the metallic mandrel 706. A release agent may be applied on the metal mandrel 706 or a low friction film [e.g., polytetrafluoroethylene (PTFE)] is first wrapped on the mandrel 706, and the ACT impregnated fibers are wound over the release agent or low friction film on the rotating mandrel 706. This can facilitate an easier demolding.

Embodiments herein provide for dissolvable downhole tools (or components thereof) that are a composite of ACT and filler material or reinforcement material (e.g., fibers, particles, etc.). The ACT can have a $T_g$ up to about 307° C., e.g., in the ranges of 150° C. to 307° C., 170° C. to 307° C., and 267° C. to 307° C., and in which the ACT and the ACT composite downhole tool or downhole tool component can withstand temperatures up to 350° C., e.g., in the ranges of 300° C. to 350° C., or 320° C. to 350° C. The ACT generally does not thermally degrade at temperatures below about 500° C. Embodiments include downhole tools that include ACT, and other similar applications that include ACT. The ACT polymer or resin system has a relatively high $T_g$ and thermal stability and is included herein as a matrix and binder material for fiber-reinforced composite downhole tool components.

Embodiments include reinforced ACT with fiber reinforcement. The fiber reinforcement can give improved mechanical properties. As discussed, the fiber reinforcement may be, for example, glass fiber reinforcement and/or carbon fiber reinforcement. Aramid fiber (e.g., Kevlar™ fiber) reinforcement and other fiber reinforcement are also applicable. The downhole tool (e.g., an ACT vitrimer composite mandrel of the downhole tool) may include reinforcement material including fibers that are mixed with or dispersed in the ACT to reinforce the ACT.

Material selection as the ACT composite is a consideration for effective use of downhole tools in oil and gas applications. The hydrocarbon production is often in high pressure and high temperature scenarios. The exposure to high temperature and high pressure may benefit from material systems (e.g., ACT) that have ability to withstand the demanding environment.

A feature of ATSP as a cross-linked aromatic copolyester can be ability to undergo further processing in the solid state through interchain transesterification reactions. Again, ATSP can be characterized as a vitrimer. Vitrimers are a class of plastics, which are derived from thermosetting polymers (thermosets) and are very similar to them. Vitrimers may include molecular covalent networks that can change their topology by thermally activated bond-exchange reactions. Thus, vitrimers may be crosslinked polymers featuring dynamic covalent chemistry which allows changes in network topology via thermally driven bond exchange. Subsequent process operations after cure may be mediated by a bond exchange reaction, which normally has a fixed topology. However, when heated above their $T_g$, a transition from viscoelastic solid to viscoelastic liquid may be realized, facilitating thermoplastic-like processing, such as compression, injection, extrusion, casting, and laminated molding.

The ACT vitrimer (e.g., aromatic thermosetting copolymer) utilized as resin for a downhole tool or downhole tool component can be carboxylic acid cured, anhydride cured, etc. The ACT vitrimer may be carboxylic acid cured or anhydride cured, or both. Based on the immersion test in water at room temperature (25° C.) and at the elevated temperature (93° C.), ACT vitrimer to be used in manufacturing a dissolvable downhole tool (or component thereof) shows little degradation in 7 days. For instance, based on the immersion test in water for 7 days at elevated temperature (93° C.), carbon-filled ACT vitrimer composite for downhole (e.g., downhole tool) shows little degradation or swelling in having less than 8% change in mass and volume. As indicated, ACT vitrimer as a material of construction (resin) in the manufacture of composite structures for a downhole tool has a glass transition temperature of more than 150° C.

In implementations, ACT vitrimer (e.g., as a resin or polymer in the dissolvable downhole tool) has a tensile strength of greater than 60 MPa (e.g., in the range of range 60 MPa to 107 MPa), a tensile modulus greater than 2.5 GPa (e.g., in the range of 2.5 GPa to 4.2 GPa), and an elongation at break of at least 1.5% (e.g., in the range of 1.5% to 2.5%). The tensile strength, tensile modulus, and elongation at break can be measured, for example, per American Society for Testing and Materials (ASTM) standard D638 [D638-22 or D638-14]"Standard Test Method for Tensile Properties of Plastics" (last updated Jul. 21, 2022) of ASTM international, or International Organization for Standardization (ISO) 527-2:2012 "Plastics—Determination of tensile properties—Part 2: Test conditions for moulding and extrusion plastics" (published 2012-02) last reviewed and confirmed in 2017.

ACT vitrimer to give a dissolvable downhole tool generally does not degrade in bases or alkali solutions having pH less than 11 for 7 days at room temperature and at elevated temperature of 93° C. ACT vitrimer for a downhole tool experiences little degradation in 10% hydrochloric acid (HCl) for 7 days at room temperature. ACT vitrimer to be used in manufacturing a downhole tool minimally degrades in presence of 30% hydrogen peroxide at room temperature.

Techniques other than filament winding to manufacture downhole equipment from ACT composite include automated tape placement, bladder molding, hand-layup, compression molding, extrusion molding, and pultrusion. The composite can be manufactured with fiber yarns or tapes pre-mixed or post-mixed with different fillers. The fillers may include, for instance, micro-fillers (particles or microtubes) and nanofillers (particles or nanotubes), such as carbon black, graphite, graphene, glass, silica, mica, pigment, or other nanotubes to improve mechanical properties, chemical resistance properties, flowability of the composite, conductivity, and other attributes.

While the present disclosure focuses at times on utilization of ACT as a degradable material, other epoxy based virtimers and their composites can also be used as a degradable or dissolvable material for downhole tools. Acetal epoxy based with acetal cleavable bonds and their composites can be used as a degradable material using acid catalyzed hydrolysis for downhole tools. Schiff based epoxy with C═N cleavable bonds and their composites can be used as a degradable material using hydrolysis or transamination for downhole tools. Disulfide-based epoxy with S—S cleavable bonds and their composites can be used as a degradable material using thio disulfide exchange for downhole tools. PHT-based epoxy with hexahydrotriazine cleavable bonds and their composites can be used as a degradable material using acid catalyzed hydrolysis for downhole tools. Boronic ester with boronic ester cleavable bonds and their composites can be used as a degradable material using alcoholysis/hydrolysis for downhole tools. Benzoxazine-epoxy with Di-N-benzyl-aniline cleavable bonds and their composites can be used as a degradable material using oxidative iminium formation and hydrolysis for downhole tools.

In view of the foregoing, the present disclosure may provide dissolvable downhole tools (e.g., dissolvable composite downhole tools) that include an ACT or other vitrimers. The apparatus and methods may include any of the various features disclosed herein, including one or more of the following statements.

Statement 1. A downhole tool for use in a borehole, wherein the downhole tool comprises a composite of an aromatic copolyester thermoset (ACT) and a reinforcement material, wherein the ACT has a glass transition temperature of at least 150° C., and wherein the ACT is configured to degrade in a water-based fluid having a pH of 13 or greater.

Statement 2. The downhole tool of statement 1, wherein the ACT comprises an ACT vitrimer.

Statement 3. The downhole tool of statement 1 or statement 2, wherein the water-based fluid comprises lithium hydroxide (LiOH), sodium hydroxide (NaOH), potassium hydroxide (KOH), rubidium hydroxide (RbOH), cesium hydroxide (CsOH), calcium hydroxide [$Ca(OH)_2$], strontium hydroxide [$Sr(OH)_2$], or barium hydroxide [$Ba(OH)_2$], or any combinations thereof.

Statement 4. The downhole tool of any preceding statement, wherein a solid precursor is compounded with the ACT, the solid precursor comprising LiOH, NaOH, KOH, RbOH, CsOH, $Ca(OH)_2$, $Sr(OH)_2$, or $Ba(OH)_2$, or any combinations thereof.

Statement 5. The downhole tool of any preceding statement, wherein the ACT configured to degrade comprises the ACT is configured to dissolve in the water-based fluid having a pH of 13 or greater.

Statement 6. The downhole tool of any preceding statement, wherein the downhole tool is a dissolvable downhole tool.

Statement 7. The downhole tool of any preceding statement, wherein a component of the downhole tool is dissolvable in a borehole in response to presence of the water-based fluid having a pH of 13 or greater in the borehole.

Statement 8. The downhole tool of any preceding statement, wherein the reinforcement material comprises fibers or particles, or both.

Statement 9. The downhole tool of any preceding statement, wherein the reinforcement material comprises fibers comprising carbon, glass, aramid, boron, basalt, metal, polyethylene, polypropylene, poly(p-phenylene-2,6-benzobisoxazole) (PBO), or natural fibers, or any combinations thereof, and wherein the natural fibers comprise flax or jute, or both.

Statement 10. A method of applying downhole tool, comprising: deploying the downhole tool into a wellbore, wherein the downhole tool comprises a composite of an aromatic copolyester thermoset (ACT) and a reinforcement material, and wherein the glass transition temperature of the ACT is at least 150° C.; and providing a water-based fluid having a pH of 13 or greater in the wellbore, thereby degrading the ACT of the downhole tool in the wellbore with the water-based fluid having the pH of 13 or greater.

Statement 11. The method of statement 10, wherein degrading the ACT comprises dissolving the ACT.

Statement 12. The method of statement 10 or statement 11, wherein the ACT comprises an ACT vitrimer.

Statement 13. The method of statements 10-12, wherein the water-based fluid comprises lithium hydroxide (LiOH), sodium hydroxide (NaOH), potassium hydroxide (KOH), rubidium hydroxide (RbOH), cesium hydroxide (CsOH), calcium hydroxide [$Ca(OH)_2$], strontium hydroxide [$Sr(OH)_2$], or barium hydroxide [$Ba(OH)_2$], or any combinations thereof.

Statement 14. The method of statements 10-13, wherein providing the water-based fluid comprises pumping the water-based fluid having the pH of 13 or greater into the wellbore.

Statement 15. The method of statements 10-14, wherein providing the water-based fluid comprises providing a solid precursor into the wellbore, thereby combining the solid precursor with wellbore fluid in the wellbore giving the water-based fluid having the pH of 13 or greater in the wellbore.

Statement 16. The method of statements 10-15, wherein the solid precursor comprises solid NaOH, solid KOH, or solid $Ca(OH)_2$, or any combinations thereof.

Statement 17. The method of statements 10-16, wherein the solid precursor is compounded into the ACT.

Statement 18. The method of statements 10-17, wherein the reinforcement material comprises fibers or particles, or both.

Statement 19. The method of statements 10-18, wherein the reinforcement material comprises fibers comprising carbon, glass, aramid, boron, basalt, metal, polyethylene, polypropylene, poly(p-phenylene-2,6-benzobisoxazole) (PBO), or natural fibers, or any combinations thereof, and wherein the natural fibers comprise flax or jute, or both.

Statement 20. The method of statements 10-19, comprising displacing the ACT as degraded from the wellbore.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

EXAMPLES

The Examples are given only as examples and not meant to limit the present techniques. Immersion testing was carried out by dissolving both [1] pristine compression molded ACT resin and [2]carbon fiber-reinforced ACT resin with 10 layers of carbon fibers in NaOH solution at different pH values 10, 11, 12, 13, 14.0, and 14.3 (at room temperature and 93° C.).

FIG. 6 depicts the degradation process steps of the carbon/ACT (C/ACT) composite being immersed in highly basic solutions having pH of 14.0 or 14.3. The C/ACT composite laminate 500 was placed 502 in an NaOH solution at 93° C. The ACT dissolved 504 in response, giving separated fibers 506 from the composite. The ACT utilized in the examples is an aromatic thermosetting copolyester (ATSP).

Table 1 gives results of mass degradation of the composite C/ACT in different pH solutions at different time intervals. The mass degradation of C/ACT composite at 93° C. with different pH solutions of NaOH is given. It can be observed that the samples underwent some swelling at pH 10 to 13, while the ACT resin in the C/ACT composite is fully dissolved in 2 hours at pH 14.0 [1 molar (M) NaOH] solution and pH 14.3 (2M NaOH) solution. The swelling behavior can be a step in the process of degradation because the tensile strength will often decrease during the process of swelling.

TABLE 1

Degradation of C/ACT composite in different pH solutions at different time intervals.

| pH | Time | Mass Change (%) |
|---|---|---|
| 10 | 2 hours | 5.5 |
| 10 | 1 day | 4.2 |

TABLE 1-continued

Degradation of C/ACT composite in different pH solutions at different time intervals.

| pH | Time | Mass Change (%) |
|---|---|---|
| 10 | 3 days | 3.9 |
| 10 | 7 days | 6.31 |
| 11 | 2 hours | 5.1 |
| 11 | 1 day | 3.9 |
| 11 | 3 days | 4.6 |
| 11 | 7 days | 7.37 |
| 12 | 2 hours | 4.9 |
| 12 | 1 day | 4.6 |
| 12 | 3 days | 4.8 |
| 12 | 7 days | 12.31 |
| 13 | 2 hours | 4.2 |
| 13 | 1 day | 2.2 |
| 13 | 3 days | 2.5 |
| 13 | 7 days | 24.41 |
| 14.0 | 2 hours | −100.0 |
| 14.3 | 2 hours | −100.0 |

The ACT and fibers are considered in the mass change (%) in Table 1. The material is a composite of ACT with carbon fibers. At pH of at least 14.0, fiber separates while the ACT dissolves fully, and thus significant mass loss is from matrix dissolution.

Table 2 gives the mass degradation of neat ACT (ASTP) at 93° C. with different pH NaOH solutions at different time intervals. As indicated, it was observed that the ACT samples were largely unaffected at pH 10 to 13, while the ACT resin is fully dissolved in 7 days at pH 14.0 (1M NaOH) solution and 14.3 (2M NaOH) solution.

TABLE 2

Degradation of neat ACT in different pH solutions at different time intervals.

| pH | Time | Mass Change (%) |
|---|---|---|
| 10 | 2 hours | −1.04 |
| 10 | 1 day | 0.48 |
| 10 | 3 days | −0.3 |
| 10 | 7 days | 1.10 |
| 11 | 2 hours | −0.71 |
| 11 | 1 day | 0.45 |
| 11 | 3 days | −0.3 |
| 11 | 7 days | 1.16 |
| 12 | 2 hours | −0.83 |
| 12 | 1 day | 0.28 |
| 12 | 3 days | −0.6 |
| 12 | 7 days | 1.10 |
| 13 | 2 hours | −0.79 |
| 13 | 1 day | 0.29 |
| 13 | 3 days | −0.4 |
| 13 | 7 days | 0.22 |
| 14.0 | 2 hours | −1.90 |
| 14.0 | 1 day | −30.50 |
| 14.0 | 3 days | −71.3 |
| 14.0 | 7 days | −100.00 |
| 14.3 | 2 hours | −4.25 |
| 14.3 | 1 day | −48.39 |
| 14.3 | 3 days | −93.8 |
| 14.3 | 7 days | −100.00 |

Figure 9:
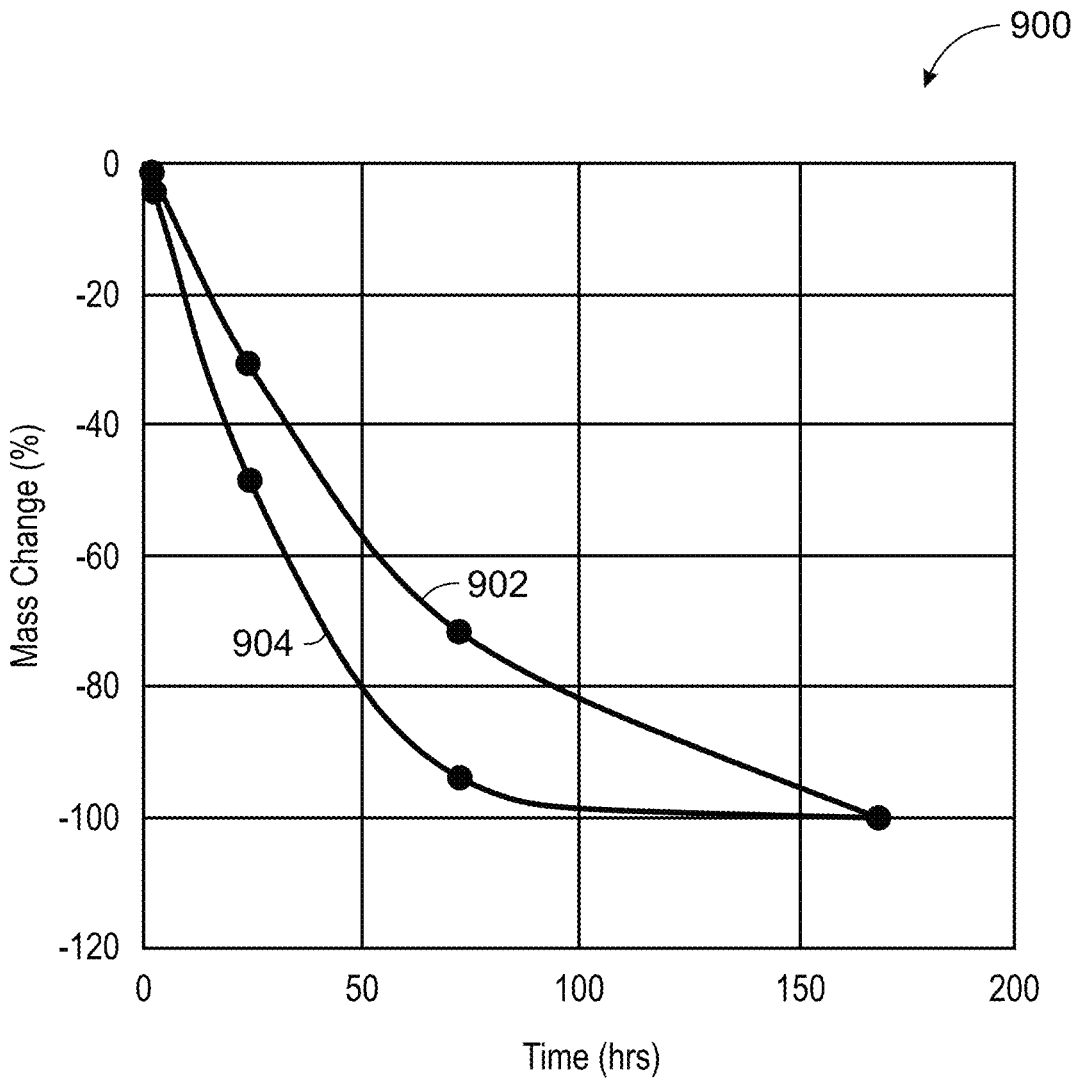
FIG. 9 is a plot of the percent mass change of neat aromatic copolyester thermoset over time in fluid having pH of 14.0 or pH of 14.3 in the Example.

FIG. 9 is a plot 900 of mass change (%) of the neat ACT over time in hours (hrs). The plot 900 gives the mass degradation versus time for neat ACT at pH of 14.0 and at pH of 14.3. The curve 902 fitted to collected data is for neat ACT at pH of 14.0. The curve 904 fitted to collected data is for neat ACT at pH of 14.3.

In implementations, the ACT polymer may pass water into the interior of the ACT polymer material, for example, through adsorption and/or through micro porosity. This water allows the solid base precursor (e.g., solid sodium hydroxide, etc.) if compounded in the ACT to hydrolyze and to form the high pH fluid. The high pH fluid initiates degradation processes in the ACT that may further accelerate the production of high pH fluid and further accelerate the degradation of the ACT.

What is claimed is:

1. A downhole tool for use in a borehole, wherein the downhole tool comprises a composite of an aromatic copolyester thermoset (ACT) and 1 to 80 weight percent of a reinforcement material comprising fibers, wherein the ACT:

has a glass transition temperature in a range of 150° C. to 350° C.;

is configured to dissolve in a water-based fluid having a pH of 13 or greater; and comprises an aromatic polyester backbone interconnected by one or more covalent bonds to form a crosslinked network of oligomers having one or more ester bonds to form an ACT vitrimer capable of dynamic transesterification.

2. The downhole tool of claim 1, wherein the water-based fluid comprises lithium hydroxide (LiOH), sodium hydroxide (NaOH), potassium hydroxide (KOH), rubidium hydroxide (RbOH), cesium hydroxide (CsOH), calcium hydroxide [$Ca(OH)_2$], strontium hydroxide [$Sr(OH)_2$], or barium hydroxide [$Ba(OH)_2$], or any combinations thereof.

3. The downhole tool of claim 1, wherein a solid precursor is compounded with the ACT, the solid precursor comprising LiOH, NaOH, KOH, RbOH, CsOH, $Ca(OH)_2$, $Sr(OH)_2$, or $Ba(OH)_2$, or any combinations thereof.

4. The downhole tool of claim 1, wherein the ACT configured to degrade comprises the ACT is configured to dissolve in the water-based fluid having a pH of 13 or greater.

5. The downhole tool of claim 1, wherein the downhole tool is a dissolvable downhole tool.

6. The downhole tool of claim 1, wherein the ACT is a material that behaves as a thermoset prior to being cured and behaves as a thermoplastic after being cured.

7. The downhole tool of claim 1, wherein a component of the downhole tool is dissolvable in a borehole in response to presence of the water-based fluid having a pH of 13 or greater in the borehole.

8. The downhole tool of claim 1, wherein the reinforcement material comprises fibers and particles.

9. The downhole tool of claim 1, wherein the reinforcement material comprises fibers comprising carbon, glass, aramid, boron, basalt, metal, polyethylene, polypropylene, poly(p-phenylene-2,6-benzobisoxazole) (PBO), flax fibers, jute fibers, or any combinations thereof.

10. The downhole tool of claim 1, wherein the downhole tool is a plug.

11. The downhole tool of claim 1, wherein the ACT comprises an ACT vitrimer having a chemical structure comprising repeat units that include benzene ring.

12. The downhole tool of claim 5, wherein a dissolvability of the dissolvable downhole tool is enabled by dynamic transesterification of the ACT vitrimer.

13. The downhole tool of claim 1, wherein the ACT vitrimer is chemically resistant to compounds including acetic acid, acetone, benzene, chlorine, dimethylformamide, dioxane, ethanol, ethyl acetate, ethylene glycol, fluorinated refrigerants, formic acid, hexanes, hydrogen chloride (pH=1), isopropanol lubricants, N-methylpyrrolidone (NMP), methanol, methylene chloride, mineral oil, nitric acid (50%), octane, phenol, silicone oil, and tetrahydrofuran, toluene.

14. A method of applying downhole tool, comprising:

deploying the downhole tool into a wellbore, wherein the downhole tool comprises a composite of an aromatic copolyester thermoset (ACT) and 1 to 80 weight percent of a reinforcement material comprising fibers, wherein the ACT:

has a glass transition temperature in a range of 150° C. to 350° C.; and comprises an aromatic polyester backbone interconnected by one or more covalent bonds to form a crosslinked network of oligomers having one or more ester bonds to form an ACT vitrimer capable of dynamic transesterification; and providing a water-based fluid having a pH of 13 or greater in the wellbore, thereby dissolving the ACT of the downhole tool in the wellbore with the water-based fluid having the pH of 13 or greater.

15. The method of claim 14, wherein the water-based fluid comprises lithium hydroxide (LiOH), sodium hydroxide (NaOH), potassium hydroxide (KOH), rubidium hydroxide (RbOH), cesium hydroxide (CsOH), calcium hydroxide [$Ca(OH)_2$], strontium hydroxide [$Sr(OH)_2$], or barium hydroxide [$Ba(OH)_2$], or any combinations thereof.

16. The method of claim 14, wherein providing the water-based fluid comprises pumping the water-based fluid having the pH of 13 or greater into the wellbore.

17. The method of claim 14, wherein providing the water-based fluid comprises providing a solid precursor into the wellbore, thereby combining the solid precursor with wellbore fluid in the wellbore giving the water-based fluid having the pH of 13 or greater in the wellbore.

18. The method of claim 17, wherein the solid precursor comprises solid NaOH, solid KOH, or solid $Ca(OH)_2$, or any combinations thereof.

19. The method of claim 17, wherein the solid precursor is compounded into the ACT.

20. The method of claim 14, wherein the reinforcement material comprises fibers and particles.

21. The method of claim 14, wherein the reinforcement material comprises fibers comprising carbon, glass, aramid, boron, basalt, metal, polyethylene, polypropylene, poly(p-phenylene-2,6-benzobisoxazole) (PBO), flax fibers, jute fibers, or any combinations thereof.

22. The method of claim 14, comprising displacing the ACT as degraded from the wellbore.

* * * * *